US007597321B2

(12) United States Patent
Sawai

(10) Patent No.: US 7,597,321 B2
(45) Date of Patent: Oct. 6, 2009

(54) IMAGE FORMING APPARATUS

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 323 days.

(21) Appl. No.: 11/242,933

(22) Filed: Oct. 5, 2005

(65) Prior Publication Data

US 2006/0082049 A1 Apr. 20, 2006

(30) Foreign Application Priority Data

Oct. 14, 2004 (JP) ..... 2004-300626

(51) Int. Cl.
*B65H 5/00* (2006.01)

(52) U.S. Cl. ..... 271/264; 271/10.04; 271/272; 271/275; 271/314

(58) Field of Classification Search ..... 271/10.04, 271/264, 314, 272, 275
See application file for complete search history.

(56) References Cited

U.S. PATENT DOCUMENTS

| | | | | |
|---|---|---|---|---|
| 1,593,251 | A * | 7/1926 | Flintermann | 384/302 |
| 3,647,268 | A * | 3/1972 | Haines | 384/516 |
| 3,860,353 | A * | 1/1975 | Lukasik et al. | 403/351 |
| 3,887,249 | A * | 6/1975 | Rouch | 384/310 |
| 4,597,676 | A * | 7/1986 | Vohr et al. | 384/114 |
| 5,778,731 | A * | 7/1998 | Heep | 74/498 |
| 6,178,843 | B1 * | 1/2001 | Machida et al. | 74/498 |
| 6,604,859 | B1 * | 8/2003 | Bonazoli | 384/397 |
| 6,813,968 | B2 * | 11/2004 | Miyaguchi et al. | 74/424 |
| 2004/0017461 | A1 * | 1/2004 | Saito | 347/104 |

FOREIGN PATENT DOCUMENTS

| | | |
|---|---|---|
| JP | 10-184663 A | 7/1998 |
| JP | 11-240644 | 9/1999 |
| JP | 11-241724 | 9/1999 |
| JP | 2000-075598 A | 3/2000 |
| JP | 2002-122132 A | 4/2002 |
| JP | 2004-025587 | 1/2004 |

* cited by examiner

*Primary Examiner*—Patrick H Mackey
*Assistant Examiner*—Howard Sanders
(74) *Attorney, Agent, or Firm*—Global IP Counselors, LLP

(57) ABSTRACT

An image forming apparatus has a chassis, a feed roller rotatably supported by the chassis, a feed roller gear relatively unrotatably coupled to the feed roller, a motor that drives the feed roller, a drive gear that receives driving force from the motor, and an intermediate gear having a gear portion that engages the drive gear and the feed roller gear and an axle portion that is rotatably supported to the chassis via intermediate gear bearings. At least one of the intermediate gear bearings includes a substantially circular inner surface and a stepped portion that is depressed from the circular inner surface. The axle portion of the intermediate gear is supported by the stepped portion while the intermediate gear transmits driving force the motor from the drive gear to the feed roller gear during printing.

7 Claims, 9 Drawing Sheets

PRIOR ART

PRIOR ART

IMAGE FORMING APPARATUS

BACKGROUND OF THE INVENTION

1. Field of the Invention

The present invention relates to an image forming apparatus. More specifically, the present invention relates to an image forming apparatus having an intermediate gear bearing that rotatably supports an intermediate gear for transmitting drive force.

2. Background Information

In conventional practice, structures having intermediate gear bearings that rotatably support intermediate gears are known.

Also, heat transfer printers are conventionally known as an example of image forming apparatuses. The structure of the heat transfer printer according to a conventional example will now be described with reference to FIGS. 13 through 16.

A heat transfer printer is generally equipped with a motor for driving various rollers. Such motor generally has a motor gear that engages a drive gear, such as a drive gear 113 shown in FIG. 14. The motor transmits the torque to a feed roller 115 via the drive gear 113 and an intermediate gear 114. The drive gear 113 is provided with an axle 113*c*, a large gear 113*a* that meshes with the motor gear, and a small gear 113*b* that meshes with a large gear 114*a* provided to the intermediate gear 114 and has a smaller diameter than the large gear 113*a*. Also, the intermediate gear 114 is provided with an axle 114*c*, the large gear 114*a* that meshes with the small gear 113*b* of the drive gear 113, a small gear 114*b* that meshes with the feed roller gear 115 and has a smaller diameter than the large gear 114*a*. The axle 114*c* of the intermediate gear 114 is rotatably supported by an intermediate gear bearing 109*b* and an intermediate gear bearing 110*b*.

As shown in FIG. 13, the intermediate gear bearing 109*b* and the intermediate gear bearing 110*b* have circular inner surfaces. As shown in FIGS. 15 and 16, the intermediate gear bearing 110*b* and the intermediate gear bearing 109*b* support both ends of the axle 114*c* at contact positions Q.

As shown in FIG. 14, when the intermediate gear 114 receives the force P6 as the resultant force of the force P4 the large gear 114*a* receives from the small gear 113*b* of the drive gear 113 and the force P5 received as a reaction when the small gear 114*b* rotates the feed roller gear 115. The intermediate gear bearing 10*b* shown in FIG. 15 and the intermediate gear bearing 109*b* shown in FIG. 16 are thereby pressed by the axle 114*c* of the intermediate gear 114 along the line of the resultant force P6.

As the axle 114*c* of the intermediate gear 114 rotates in the direction of arrow F2, frictional force μP6 (μ is a dynamic friction coefficient) acts on the contact part Q of the axle 114*c*. As a result of this frictional force μP6, the axle 114*c* of the intermediate gear 114 begins to move along the inner surfaces of the intermediate gear bearing 110*b* and the intermediate gear bearing 109*b*. The axle 114*c* of the intermediate gear 114 then stops moving at a position inclined by an angle θ3, at which the following equation is satisfied:

$$\mu P6 \cos \theta 3 \text{ (the frictional force)} = P6 \sin \theta 3 \text{ (the resultant force)}$$

The axle 114*c* of the intermediate gear 114 is thereby rotated while maintaining a contact with the intermediate gear bearings 109*b* and 110*b* at the contact part Q, which is inclined by the angle θ3.

In the conventional heat transfer printer shown in FIGS. 13 through 16, the frictional force μP6 increases or decreases when the resultant force P6 received by the axle 114*c* of the intermediate gear 114 varies as a result of variations in the force received by the paper during the printing operation. This is disadvantageous in that the axle 114*c* of the intermediate gear 114 moves along the inner surfaces of the intermediate gear bearing 110*b* and the intermediate gear bearing 109*b*.

Specifically, when the load received by the paper during the printing operation increases and the force P5 (see FIG. 14) for rotating the feed roller 102 that conveys the paper becomes greater, the frictional force μP6 (see FIGS. 15 and 16) that is generated as the axle 114*c* of the intermediate gear 114 rotates also increases. Accordingly, the contact point at which the axle 114*c* of the intermediate gear 114 contacts the intermediate gear bearings 109*b* and 110*b* moves so that the angle θ3 widens.

Conversely, when the load received by the paper during the printing operation decreases and the reaction P5 (see FIG. 14) for rotating the feed roller 102 that conveys the paper becomes smaller, the frictional force μP6 (see FIGS. 15 and 16) for moving the axle 114*c* of the intermediate gear 114 decreases. Accordingly, the contact point at which the axle 114*c* of the intermediate gear 114 contacts the intermediate gear bearings 109*b* and 110*b* moves so that the angle θ3 is narrowed. At this time, the axle 114*c* of the intermediate gear 114 moves along the inner surfaces of the intermediate gear bearing 110*b* and the intermediate gear bearing 109*b* without rotating the intermediate gear 114, which is disadvantageous in that the amount of rotation of the intermediate gear 114 becomes inconsistent.

In conventional structure, as described above, when the amount of rotation of the intermediate gear 114 varies, the rotation of the feed roller gear 115 also varies, causing undesirable variations in the distance by which the paper is conveyed by the feed roller 102. In this case, paper is fed non-uniformly. Thus, it is difficult to precisely control the conveyance of paper with the feed roller 102.

Furthermore, in conventional structure, in order to reduce such paper feeding non-uniformities, the intermediate gear 114 and the intermediate gear bearings 109*b* and 110*b* are formed so that there is a relatively tight fit between the outer surface of the axle 114*c* of the intermediate gear 114 and the inner surfaces of the intermediate gear bearing 10*b* and the intermediate gear bearing 109*b*. Therefore, high precision is required of the intermediate gear 114 and the structures in which the intermediate gear bearings 109*b* and 110*b* are formed. Thus, component costs are high.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

An object of the present invention is to provide an image forming apparatus in which the conveyance of paper by the feed roller can be precisely controlled without having to improve the precision components are manufactured.

An image forming apparatus in accordance with the first aspect of the present invention includes a chassis having first and second side plates; a feed roller rotatably supported between the first and second side plates for conveying the paper; a feed roller gear relatively unrotatably coupled to the feed roller; a motor configured to drive the feed roller; a drive gear arranged to receive driving force from the motor; and an intermediate gear having a gear portion that engages the drive gear and the feed roller gear and an axle portion that is rotatably supported to the chassis via intermediate gear bearings, at least one of the intermediate gear bearings including a substantially circular inner surface and a stepped portion that is either elevated or depressed from the circular inner surface, the axle portion of the intermediate gear being arranged to be supported by the stepped portion while the intermediate gear transmits driving force in one direction of the motor from the drive gear to the feed roller gear.

In the image forming apparatus, as described above, at least one of the intermediate gear bearings is provided with a stepped portion on the of the intermediate gear bearing side to which the resultant force received by the axle portion of the intermediate gear is directed. The stepped portion restricts the movement of the position of the contact between the axle portion of the intermediate gear and the intermediate gear bearings even when the resultant force varies. Therefore, the movement of the intermediate gear along the inner surfaces of the intermediate gear bearings can be restricted. The fluctuation in the amount of rotation of the intermediate gear can thereby be restricted, and the fluctuation in the amount of rotation of the feed roller driven by the intermediate gear can also be restricted. As a result, paper feeding nonuniformities induced by the fluctuation in the amount of rotation of the feed roller can be suppressed, and the conveyance of paper can therefore be controlled with higher precision. Furthermore, since it is possible to control the conveyance of paper with precision with the support units provided in the intermediate gear bearings as described above, there is no need to improve the precision with which the axle of the intermediate gear and the intermediate gear bearings are manufactured.

In image forming apparatus according to the second aspect of the present invention, the stepped portion of the intermediate gear bearing is depressed from its circular inner surface, and the axle portion of the intermediate gear is arranged to be supported by edge portions on both sides of the depressed stepped portion.

In this configuration, the axle portion of the intermediate gear can be pressed by the depressed stepped portion while being supported at two locations with edge portions provided to both sides of the stepped portion. Therefore, the movement of the axle portion of the intermediate gear along the support portion can be restricted in comparison with a case in which the axle portion is supported at one location. The movement of the position of the contacts between the axle of the intermediate gear and the intermediate gear bearings can thereby be restricted even when the resultant force varies. Accordingly, the movement of the intermediate gear along the inner surfaces of the intermediate gear bearings can be also restricted. The fluctuation in rotation of the intermediate gear can thereby be restricted, and the fluctuation in rotation of the feed roller driven by the intermediate gear can also be restricted. As a result, paper feeding nonuniformities induced by the fluctuation in rotation of the feed roller can be restricted, and the conveyance of paper can therefore be controlled with higher precision.

In the image forming apparatus according to the third aspect of the invention, the stepped portion of the intermediate gear bearing is elevated from its circular inner surface, and the elevated stepped portion has a substantially arcuate shape, with an inside diameter of curvature of the arcuate shape being substantially the same as an outside diameter of the axle portion of the intermediate gear.

In this configuration, the axle portion of the intermediate gear can be supported with an arcuate surface, and therefore the positions at which the axle portion of the intermediate gear contacts the intermediate gear bearings is less likely to move even when the resultant force changes. The movement of the intermediate gear along the inner surfaces of the intermediate gear bearings can thereby be restricted, and the fluctuation in rotation of the intermediate gear can therefore be restricted. Consequently, the fluctuation in rotation of the feed roller driven by the intermediate gear can be restricted, and paper feeding non-uniformities induced by fluctuation in rotation of the feed roller can therefore be suppressed. As a result, it is possible to control the conveying of paper with higher precision.

In the image forming apparatus according to the fourth aspect of the present invention, the axle portion and the gear portion of the intermediate gear are formed unitarily as a one-piece member. As a result of this configuration, the number of components can be reduced in comparison with a case in which the axle portion is formed separately from the gear portion.

The image forming apparatus according to the fifth aspect of the present invention further includes a resinous side plate member mounted on the first side plate of the chassis and unitarily provided with a feed roller bearing that rotatably supports the feed roller. One of the intermediate gear bearings being formed unitarily with the side plate member.

With this configuration, the number of components can be reduced in comparison with a case in which the intermediate gear bearings are formed separately from the resinous side plate.

The image forming apparatus according to the sixth aspect of the present invention further includes a motor bracket mounted on the first side plate of the chassis, the motor being mounted to the motor bracket. The other of the intermediate gear bearings being formed unitarily with the motor bracket.

With this configuration, the number of components can be reduced in comparison with a case in which the intermediate gear bearings are formed separately from the motor bracket.

In the image forming apparatus according to the seventh aspect of the present invention, the other of the intermediate gear bearings formed on the motor bracket is formed so as to project from the motor bracket.

In the image forming apparatus according to the eighth aspect of the present invention, an angular range within which the stepped portion extends relative to the circular inner surface is less than 180°.

In this configuration, the axle portion of the intermediate gear can be supported within the angle range of less than 180 degrees by the stepped portion. Therefore, the axle portion of the intermediate gear can engage with the supporting surfaces securely, even when the stepped portion is formed into an arcuate shape with an inside diameter that is substantially the same as the outside diameter of the axle of the intermediate gear. As a result, the axle portion of the intermediate gear can securely engage the stepped portion of the intermediate gear bearings that include arcuate support surfaces, and the axle portion of the intermediate gear can therefore be mounted on the intermediate gear bearings.

In the image forming apparatus according to the ninth aspect of the present invention, each of the intermediate gear bearings includes a substantially circular inner surface and a stepped portion that is elevated from its respective circular inner surface, the axle portion of the intermediate gear being arranged to be supported by the elevated stepped portions while the intermediate gear transmits driving force of the motor from the drive gear to the feed roller gear.

In the image forming apparatus according to the tenth aspect of the present invention, each of the intermediate gear bearings includes a substantially circular inner surface and a stepped portion that is depressed from its respective circular inner surface, the axle portion of the intermediate gear being arranged to be supported by the depressed stepped portions while the intermediate gear transmits driving force of the motor from the drive gear to the feed roller gear.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The embodiments of the present invention will be described below with reference to the diagrams.

First Embodiment

Figure 1:
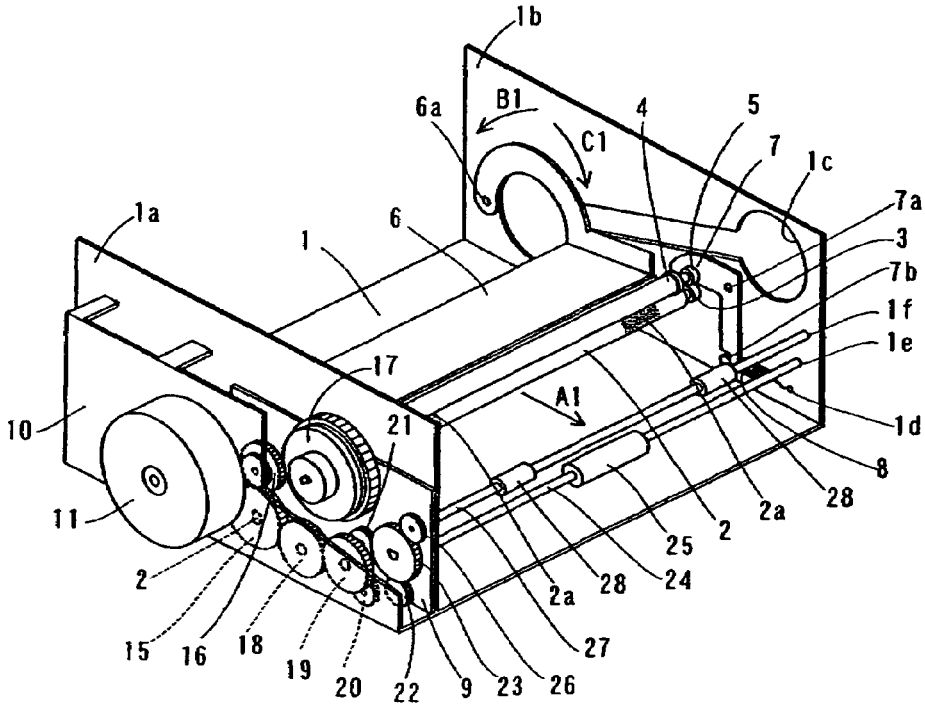
FIG. 1 is a perspective view of the entire structure of a heat transfer printer according to the first embodiment of the present invention.
Figure 2:
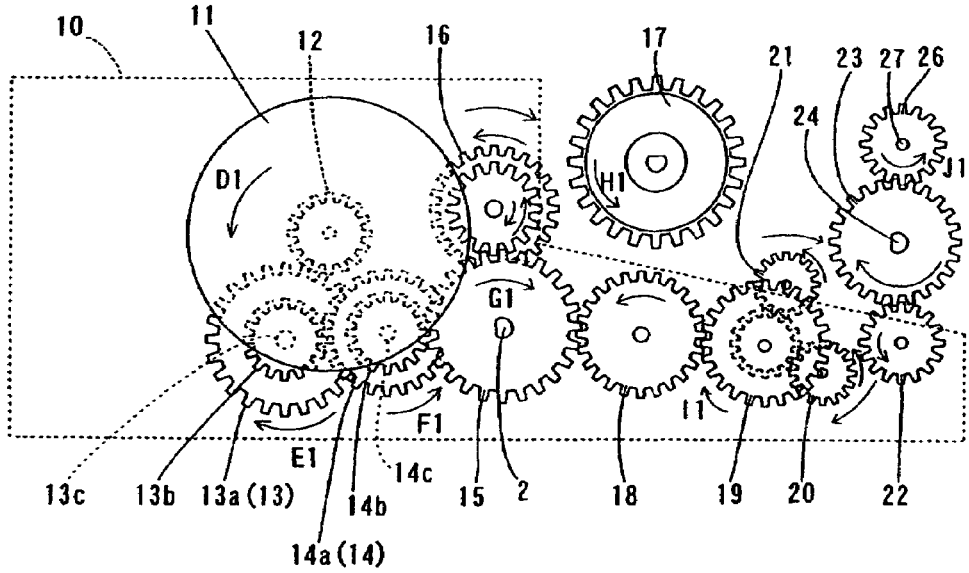
FIG. 2 is a schematic view of the motor and gears in the heat transfer printer according to the first embodiment shown in FIG. 1.
Figure 3:
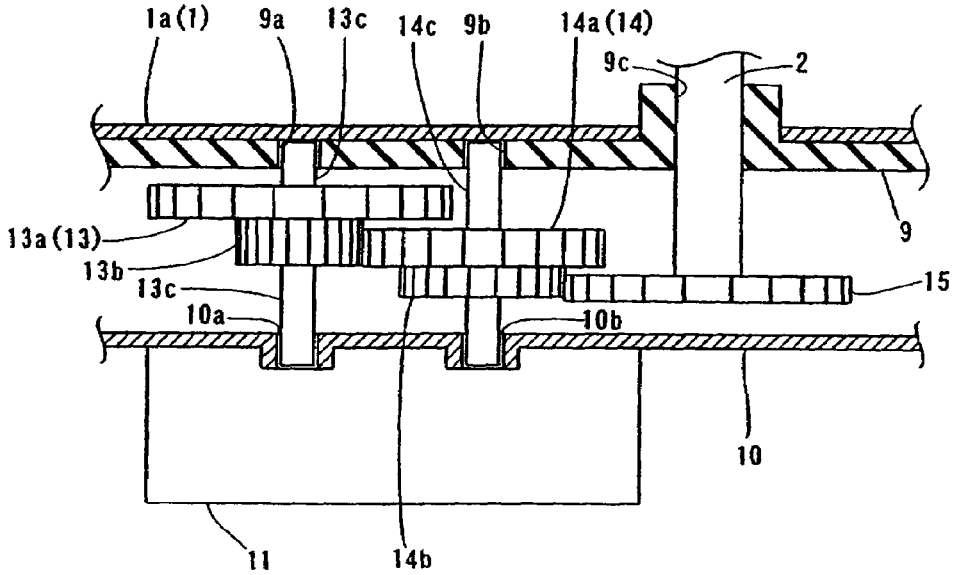
FIG. 3 is a partial plan view of the motor and gears in the heat transfer printer according to the first embodiment shown in FIG. 1.

FIG. 1 is a perspective view showing the general structure of a heat transfer printer according to the first embodiment of the present invention. FIG. 2 is a front view showing the motor and gears in the heat transfer printer according to the first embodiment of the present invention shown in FIG. 1. FIG. 3 is a plan view showing the motor and gears in the heat transfer printer according to the first embodiment of the present invention shown in FIG. 1. FIGS. 4 through 7 are diagrams showing the details of the structure of the heat transfer printer according to the first embodiment of the present invention shown in FIG. 1. The structure of the heat transfer printer according to the first embodiment of the present invention will now be described with reference to FIGS. 1 through 7. In the first embodiment, a heat transfer printer is described as an example of the image forming apparatus of the present invention.

As shown in FIGS. 1 and 2, the heat transfer printer according to the first embodiment includes a metal chassis 1 with a first side plate 1*a* and a second side plate 1*b*, a feed roller 2, feed roller bearings 3 that rotatably support the feed roller 2, a press roller 4 that comes into contact with the feed roller 2 with a specific amount of pressure, press roller bearings 5 that rotatably support the press roller 4, a thermal head 6 that performs printing on paper with a platen roller (not shown in Figures) against which the thermal head 6 is pressed to perform printing, metallic bearing support plates 7, tension coil springs 8, a resinous side plate member 9, a metallic motor bracket 10, a motor 11 mounted on the motor bracket 10, a motor gear 12 (see FIG. 2), a drive gear 13, a resinous intermediate gear 14 rotatably supported to the chassis 1, a feed roller gear 15 that rotates with the feed roller 2, a swinging gear 16, an ink sheet winding gear 17, transmission gears 18 through 22, a paper supply roller axle gear 23, a paper supply roller axle 24 that rotates with the paper supply roller axle gear 23, a rubber paper supply roller 25 (see FIG. 1) mounted on the paper supply roller axle 24, a paper ejection roller axle gear 26, a paper ejection roller axle 27 that rotates with the paper ejection roller axle gear 26, and rubber paper ejection rollers 28 mounted on the paper ejection roller axle 27.

Also, as shown in FIG. 1, the second side plate 1*b* of the chassis 1 is provided with an ink sheet cartridge insertion hole 1*c* through which an ink sheet cartridge (not shown) containing ink sheets is inserted. The second side plate 1*b* of the chassis 1 is also provided with a tension coil spring mounting hole 1*d* for mounting one end of the tension coil spring 8. The first side plate 1*a* and the second side plate 1*b* of the chassis 1 are provided with paper supply roller axle mounting holes 1*e* for rotatably supporting the paper supply roller axle 24. The first side plate 1*a* and second side plate 1*b* of the chassis 1 are also provided with paper ejection roller axle mounting holes 1*f* for rotatably supporting the paper ejection roller axle 27.

The feed roller 2 for conveying paper is provided with paper conveying portions 2*a*. The front surface of the paper conveying portions 2*a* of the feed roller 2 are machined by rolling, and convex portions having a specific height are formed in each paper conveying portion 2*a*.

Also, the thermal head 6 is pivotably mounted on the inner sides of the first side plate 1*a* and second side plate 1*b* of the chassis 1 to be capable of pivoting around a spindle 6*a*. The thermal head 6 is urged in a direction away from the paper (direction of arrow B1 in FIG. 1).

The bearing support plates 7 that support the press roller bearings 5 are mounted on the inner sides of the first side plate 1*a* and the second side plate 1*b* of the chassis 1 so as to be capable of pivoting around support units 7*a*. Also, each of the bearing support plate 7 has a spring mounting unit 7*b* to which the other end of the tension coil spring 8 is mounted. The tension coil spring 8 urges the press roller 4, via the bearing support plate 7 and the press roller bearings 5, in the direction in which the press roller 4 is pressed against the feed roller 2.

Also, the side plate member 9 and the motor bracket 10 are mounted on the first side plate 1*a* of the chassis 1. The motor 11 is a conventional motor, which functions as the drive source for the feed roller 2, the ink sheet winding gear 17, the paper supply roller 25, and the paper ejection roller 28, is mounted in the motor bracket 10. There is no limitation as to the type of motor to be utilized as the motor 11. Any known motor that can satisfactorily function in the structure of the present invention can be the motor 11. As shown in FIG. 2, the motor gear 12 that rotates with the motor 11 is mounted on the motor 11. The drive gear 13 is provided with an axle 13*c*, a large gear 13*a* that meshes with the motor gear 12, and a small gear 13*b* that meshes with a large gear 14*a* (an example of the gear portion of the intermediate gear) of the intermediate gear 14 and has a smaller diameter than the large gear 13*a*. As shown in FIG. 3, the axle 13*c* of the drive gear 13 is rotatably supported by a drive gear bearing 9*a* formed on the side plate member 9, and a drive gear bearing 10*a* formed on the motor bracket 10.

The intermediate gear 14 has an axle 14*c*, the large gear 14*a* that meshes with the small gear 13*b* of the drive gear 13 as described above, and a small gear 14*b* (another example of the gear portion of the intermediate gear) that meshes with the feed roller gear 15 and has a smaller diameter than the large gear 14*a*. In the first embodiment, the large gear 14*a*, the small gear 14*b*, and the axle 14*c* are formed integrally and unitarily as a one-piece member. The axle 14*c* of the intermediate gear 14 is rotatably supported by the intermediate gear bearing 9*b* provided unitarily with the side plate member 9, and the intermediate gear bearing 10*b* provided unitarily with the motor bracket 10.

Figure 4:
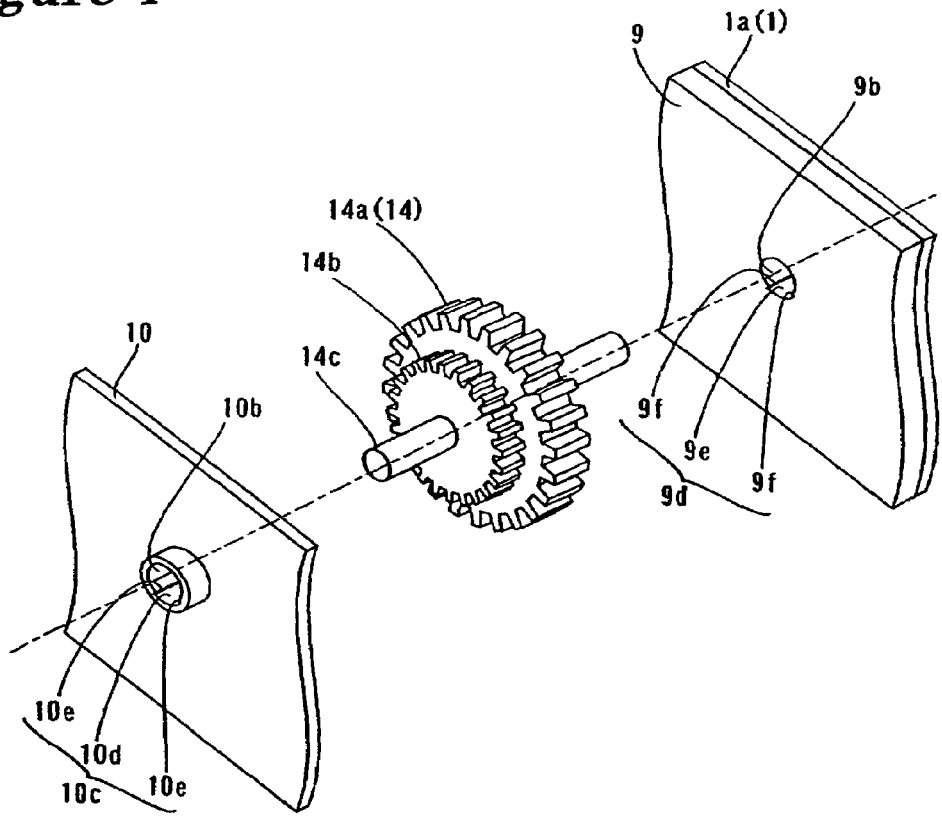
FIG. 4 is a partial exploded perspective view of the structure for mounting the intermediate gear in the heat transfer printer according to the first embodiment shown in FIG. 1.

The intermediate gear bearing 10*b* of the motor bracket 10 is formed by burring so as to protrude from the motor bracket 10 as shown in FIG. 4. Also, the intermediate gear bearing 9*b* of the side plate member 9 is provided with a substantially circular inner surface 9*g* and a support portion 9*d* (an example of the stepped portion, see FIG. 7). Similarly, the intermediate gear bearing 10*b* of the motor bracket 10 is provided with a substantially circular inner surface 10*f* and a support portion 10*c* (another example of the stepped portion, see FIG. 6). In this embodiment, the support portions 9*g* and 10*f* are depressed from the circular inner surfaces 9*g* and 10*f*.

Figure 5:
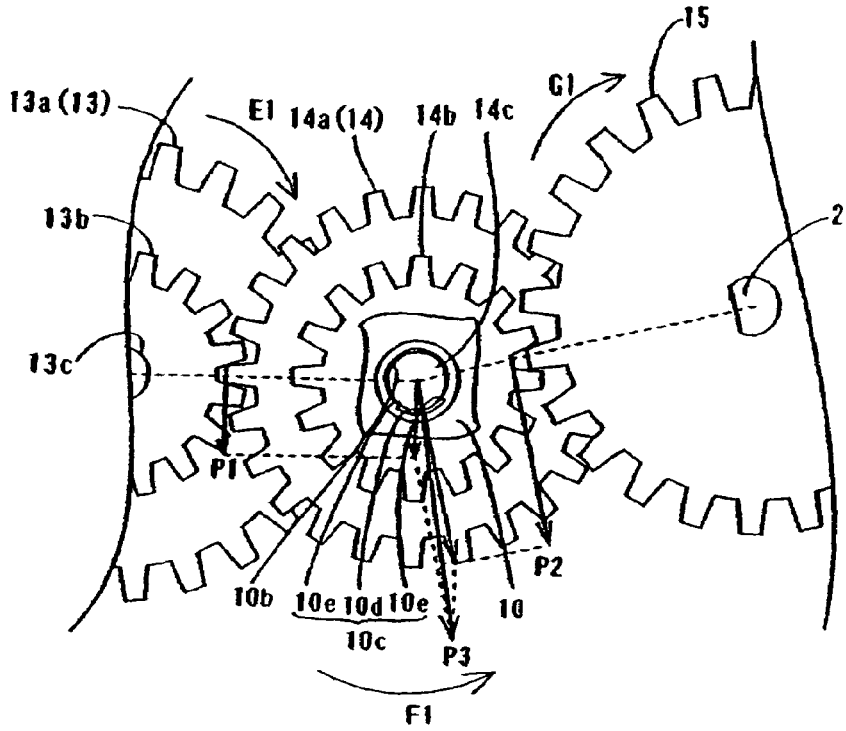
FIG. 5 is a partial schematic view of the intermediate gear, the drive gear and the feed roller gear in the heat transfer printer according to the first embodiment shown in FIG. 1.
Figure 6:
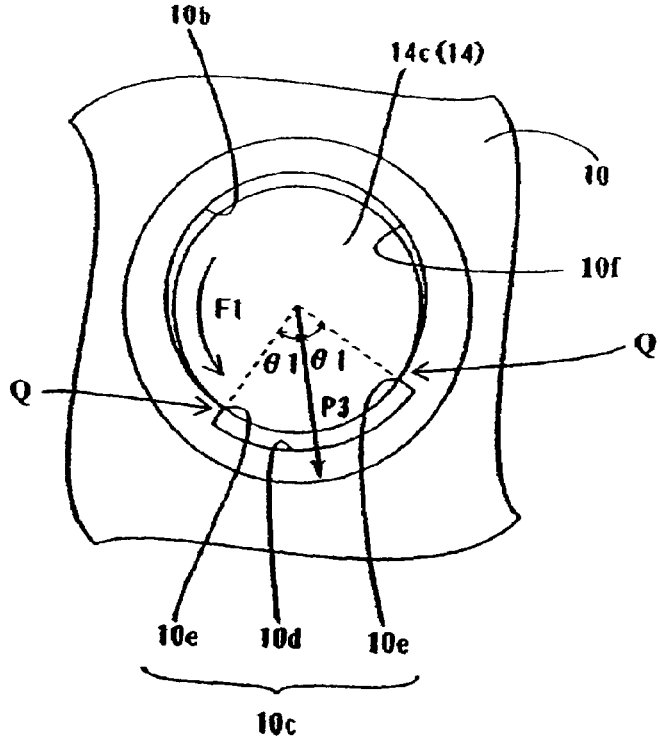
FIG. 6 is a partial enlarged view of the intermediate gear formed in the motor bracket in the heat transfer printer according to the first embodiment shown in FIG. 1.
Figure 7:
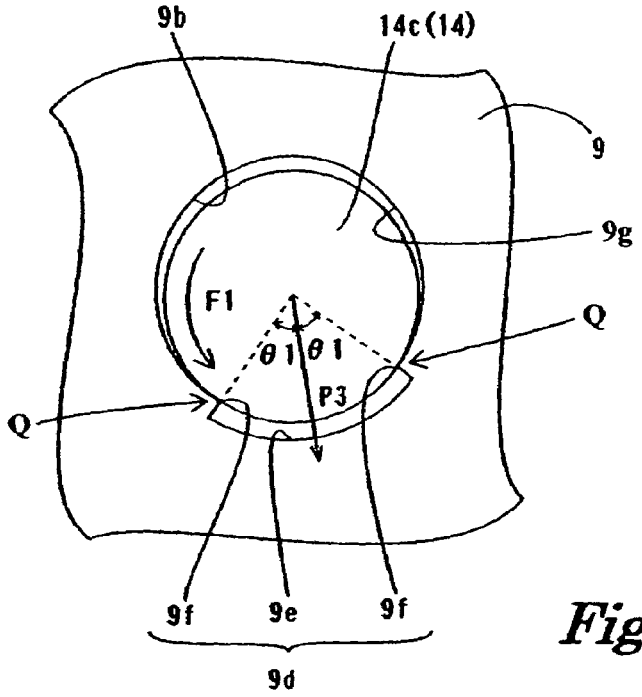
FIG. 7 is a partial enlarged view of the intermediate gear bearing formed in the side plate in the heat transfer printer according to the first embodiment shown in FIG. 1.

As shown in FIG. 5, the intermediate gear 14 receives a force P3 as a resultant force of the force P1 that the large gear 14*a* receives from the drive gear 13 when the drive gear 13 rotates in the direction of E1, and the force P2 that the small gear 14*b* receives as a reaction when the feed roller gear 15 is rotated in the direction of G1. As shown in FIGS. 7 and 6, the support portion 9*d* and the support portion 10*c* are provided on the side of the intermediate gear bearings 9*b* and 10*b* to which this resultant force P3 directed, so as to restrict movement of the positions Q at which the axle 14*c* of the intermediate gear 14 and the intermediate gear bearings 9*b* and 10*b* contact, even when the resultant force P3 varies.

The support portion 9*d* is provided with a concave portion 9*e* and two projections (or edge portions) 9*f* provided to both sides of the concave portion 9*e*, as shown in FIG. 7. These two projections 9*f* are disposed at two positions inclined by a specific angle θ1 relative to the left and right of the direction in which the force P3 is directed, so as to support the axle 14*c* of the intermediate gear 14 in linear fashion. Also, as shown in FIG. 6, the support portion 10*c* is provided with a depressed portion 10*d* and two projections (or edge portions) 10*e* provided to both sides of the depressed portion 10*d*. These two projections 10*e* are disposed at two positions inclined to the left and right of the force P3 by a specific angle θ1, so as to support the axle 14*c* of the intermediate gear 14 with two linear contact positions Q.

Also, a feed roller bearing 9*c* provided unitarily with the side plate member 9 rotatably supports one end of the feed roller 2 on which the feed roller gear 15 is mounted, as shown in FIG. 3.

Next, the printing operation of the heat transfer printer according to the first embodiment of the present invention will be described with reference to FIGS. 1, 2, and 5 through 7. First, as shown in FIG. 2, the motor gear 12 mounted on the motor 11 rotates in the direction of arrow D1 in conjunction with the driving of the motor 11. The drive gear 13 and the intermediate gear 14 are thereby rotated respectively in the direction of arrow E1 and the direction of arrow F1. Accordingly, the feed roller gear 15 rotates in the direction of arrow G1. At this time, the swinging gear 16 swings toward the ink sheet winding gear 17 and meshes with the ink sheet winding gear 17, rotating the ink sheet winding gear 17 in the direction of arrow H1. An ink sheet winding member (not shown) for winding ink sheets (not shown) is thereby rotated.

Also, the thermal head 6 is pivoted in the direction toward the platen roller, in which the ink sheet (not shown) and the paper are pressed against each other (direction of arrow C1 in FIG. 1) by the driving of a motor (not shown) which is provided separately from the motor 11. Printing is thereby performed on the paper.

As shown in FIG. 2, the feed roller 2 mounted on the feed roller gear 15 is rotated in the direction of arrow G1 along with the rotation of the feed roller gear 15 in the direction of arrow G1. The feed roller 2 thereby conveys paper in the paper ejection direction (printing direction), which is the direction of arrow A1 in FIG. 1. Also, the transmission gear 19 is rotated in the direction of arrow I1 via the transmission gear 18 by the rotation of the feed roller gear 15 in the direction of arrow G1.

At this time, the rocking transmission gear 21 moves toward the paper supply roller axle gear 23 and meshes with the paper supply roller axle gear 23. Therefore, the paper ejection roller axle gear 26 is rotated in the direction of arrow J1 via the transmission gear 21 and the paper supply roller axle gear 23 by the rotation of the transmission gear 19 in the direction of arrow I1. Accordingly, the paper ejection rollers 28 that rotate with the paper ejection roller axle gear 26 convey paper in the paper ejection direction (printing direction), which is the direction of arrow A1 in FIG. 1.

At this time, in the first embodiment, as shown in FIG. 5, the intermediate gear 14 receives the force P3 as a resultant force from the force P1 received from the drive gear 13 and the force P2 received as reaction when the feed roller gear 15 is rotated. The two projections 10*e* of the support portion 10*c* shown in FIG. 6 and the two projections 9*f* of the support portion 9*d* shown in FIG. 7 are thereby pressed by the axle 14*c* of the intermediate gear 14.

At this time, frictional force resulting from the resultant force P3 acts on the axle 14*c* of the intermediate gear 14, which rotates in the direction of arrow F1. This frictional force operates on the axle 14*c* of the intermediate gear 14 in the opposite direction from the rotation direction of the intermediate gear 14 (direction of arrow F1). Also, this frictional force changes due to variations in the force received by the paper during the printing operation. Specifically, when the load received by the paper during printing increases and the reaction P2 for rotating the feed roller 2 becomes larger, the frictional force that acts on the axle 14*c* of the intermediate gear 14 in the opposite direction of the arrow F1 increases as well. Conversely, when the load received by the paper during printing decreases and the force P2 becomes smaller, the frictional force that acts on the axle 14*c* decreases as well. Thus, as a result of the change in the frictional force, the axle 14*c* of the intermediate gear 14 is moved to the left and right along the two projections 10*e* of the support portion 10*c* and the two projections 9*f* of the support portion 9*d*.

In the first embodiment, as described above, the intermediate gear bearings 9*b* and 10*b* are provided with support portions 9*d* and 10*c* on the side of the intermediate gear bearings 9*b* and 10*b* toward which the resultant force P3 received by the axle 14*c* of the intermediate gear 14 is directed. The support portions 9*d* and 10*c* restrict the movement of the positions Q at which the axle 14*c* of the intermediate gear 14 and the intermediate gear bearings 9*b* and 10*b* come into contact, even when in the magnitude of the resultant force P3 varies. As a result, the intermediate gear 14 can be limited in its ability to move along the inner surfaces of the intermediate gear bearings 9*b* and 10*b*.

Accordingly, the fluctuation in the amount of rotation of the intermediate gear 14 can be thereby limited, and the fluctuation in the amount of rotation of the feed roller 2 can also be limited. As a result, paper feeding non-uniformities induced by the fluctuation in the amount of rotation of the feed roller 2 can be suppressed, and the conveying of paper can therefore be controlled with higher precision.

Furthermore, since it is possible to control the conveyance of paper with precision by providing support units 9*d* and 10*c* to the intermediate gear bearings 9*b* and 10*b* as described above, the precision with which the axle 14*c* of the intermediate gear 14 and the intermediate gear bearings 9*b* and 10*b* have to been manufactured can be lessened.

Also, in the first embodiment, the intermediate gear bearings 9*b* and 10*b* further include depressed portions 9*e* and 10*e* provided on the side of the direction of the resultant force P3, as well as the projections 9*f* and 10*e* on both sides of the depressed portions 9*e* and 10*e*. Accordingly, the axle 14*c* of the intermediate gear 14 can be pressed against the sides of the depressed portions 9*e* and 10*e* while being supported at two positions Q by the pair of projections 9*f* and 10*e* provided to both sides of the depressed portions 9*e* and 10*e*. Therefore, the movement of the axle 14*c* of the intermediate gear 14 along the projections 9*f* and 10*e* can be restricted in comparison with the case in which the axle is supported at one location. Thus, the movement of the axle 14*c* of the intermediate gear 14 along the projections 9*f* and 10*e* can be restricted even when the resultant force P3 varies. Therefore, the contact positions Q between the axle 14*c* and the intermediate gear bearings 9*b* and 10*b* can be restricted from moving even when the resultant force P3 varies. As a result, the fluctuation in the rotation of the intermediate gear 14 and the fluctuation in the rotation of the feed roller 2 can be restricted. As a result, paper feeding nonuniformities induced by the fluctuation in the rotation of the feed roller 2 can be suppressed, and the conveyance of paper can therefore be controlled with higher precision.

Also, in the first embodiment, the axle 14*c* of the intermediate gear 14 is formed unitarily with the large and small gears 14*a* and 14*b* of the resinous intermediate gear 14. Therefore, the number of components can be reduced in comparison with a case in which the axle 14*c* is formed separately.

Also, in the first embodiment, the image forming apparatus further includes the chassis 1 having the first side plate 1*a* and the second side plate 1*b*, and the resinous side plate member 9 mounted on the first side plate 1*a* of the chassis 1 and provided unitarily with the feed roller bearings 9*c* that rotatably supports the feed roller 2. The intermediate gear bearing 9*b* is provided so as to rotatably support one end of the axle 14*c* of the intermediate gear 14, and is formed unitarily with the resinous side plate member 9. Therefore, the number of components can be reduced in comparison with a case in which the intermediate gear bearing 9*b* is formed separately from the resinous side plate member 9.

Also, in the first embodiment, the metallic motor bracket 10, on which the motor 11 is mounted as a drive source for the feed roller 2, is provided unitarily with the intermediate gear bearing 10*b*, which rotatably supports the other end of the axle 14*c* of the intermediate gear 14. Therefore, the number of components can be reduced in comparison with a case in which the intermediate gear bearing 10*b* is provided separately from the motor bracket 10.

Second Embodiment

Figure 8:
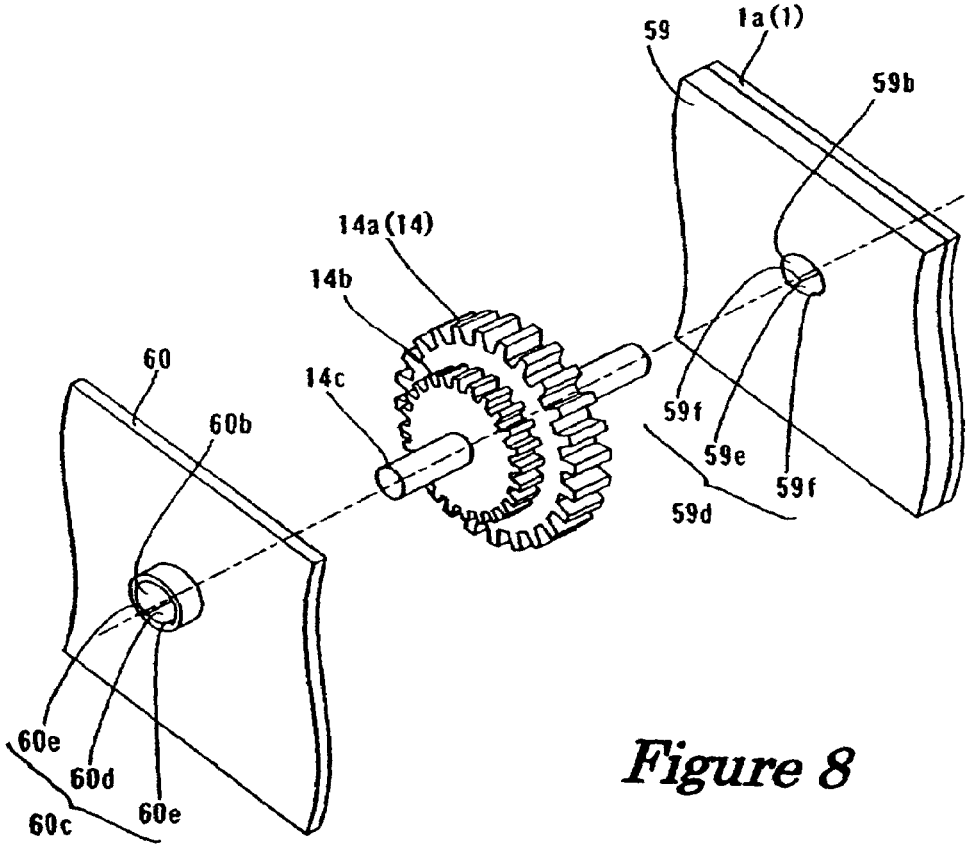
FIG. 8 is a partial exploded perspective view of the structure for mounting the intermediate gear in the heat transfer printer according to the second embodiment of the present invention.
Figure 9:
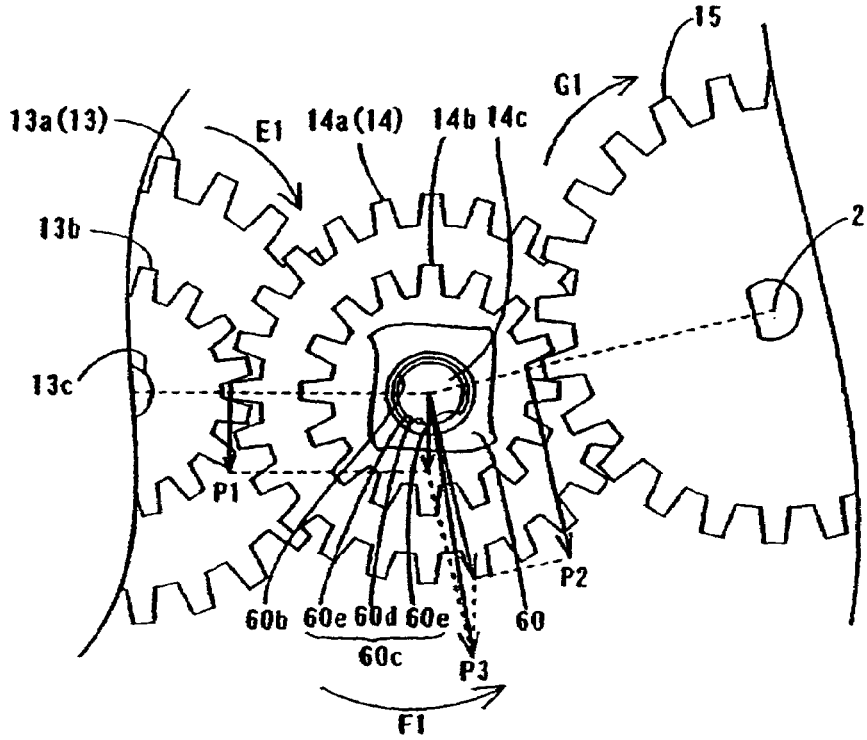
FIG. 9 is a partial schematic view of the intermediate gear, the drive gear, and the feed roller gear in the heat transfer printer according to the second embodiment shown in FIG. 8.
Figure 10:
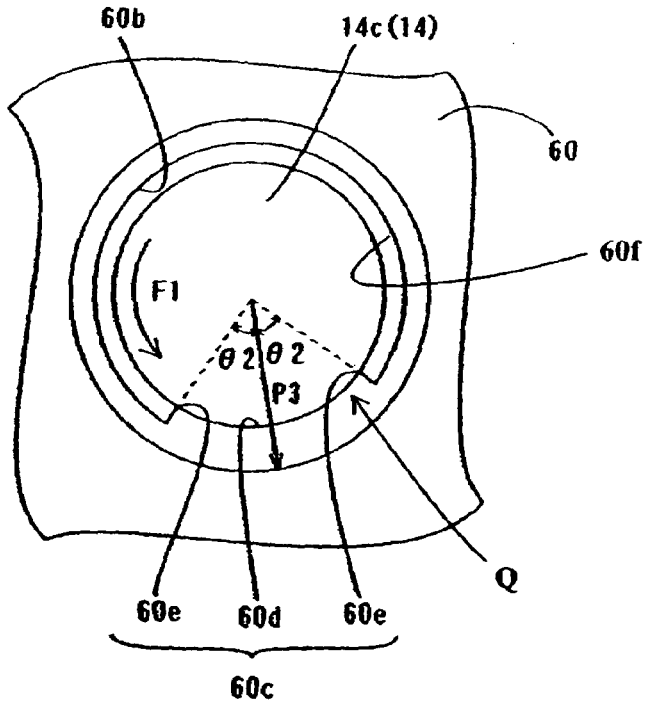
FIG. 10 is a partial schematic view of the intermediate gear bearing formed in the motor bracket in the heat transfer printer according to the second embodiment shown in FIG. 8.
Figure 11:
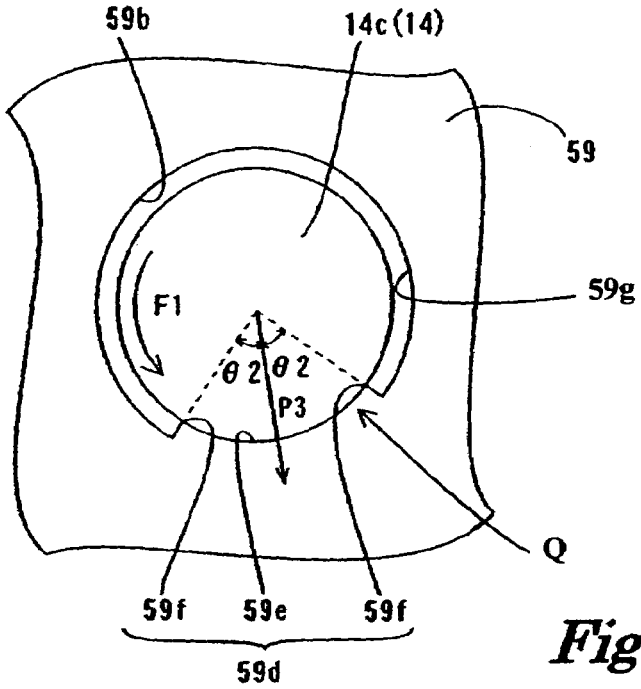
FIG. 11 is a partial schematic view of the intermediate gear bearing formed in the side plate in the heat transfer printer according to the second embodiment shown in FIG. 8.

FIG. 8 is an exploded schematic perspective view showing the structure in which the intermediate gear is mounted in the heat transfer printer according to the second embodiment of the present invention. FIG. 9 is a detailed view showing the intermediate gear in the heat transfer printer according to the second embodiment shown in FIG. 8. FIG. 10 is a partial enlarged view showing the intermediate gear bearing of the motor bracket in the heat transfer printer according to the second embodiment shown in FIG. 8. FIG. 11 is a partial enlarged view showing the intermediate gear bearing of the side plate in the heat transfer printer according to the second embodiment shown in FIG. 8.

In the second embodiment, an example will be described in which the support units of the intermediate gear bearings are provided with support surfaces that support the axle of the intermediate gear with an arcuate surface, unlike the first embodiment. The structures in the second embodiment, other than the support units of the intermediate gear bearings, are identical to those in the first embodiment. In view of the similarity between the first and second embodiments, the parts of the second embodiment that are identical to the parts of the first embodiment will be given the same reference numerals as the parts of the first embodiment. Furthermore, detailed descriptions of the structures of the second embodiment that are identical to those of the first embodiment will be omitted.

In the heat transfer printer according to the second embodiment, as shown in FIG. 8, support portions 59*d* and 60*c* (still another examples of the stepped portion) and substantially circular inner surfaces 59*g* and 60*f* are provided to an intermediate gear bearing 59*b* formed on a side plate 59, and an intermediate gear bearing 60*b* formed on a motor bracket 60. In this embodiment, the support portions 59*d* and 60*c* are elevated from the circular inner surfaces 59*g* and 60*f*. Also, as shown in FIG. 9, the intermediate gear 14 receives the force P3 as a resultant force of the force P1 received from the drive gear 13 and the force P2 received as a reaction when the feed roller gear 15 is rotated. As shown in FIGS. 11 and 10, the support portion 59*d* and 60*c* are provided to the side of the intermediate gear bearings 59*b* and 60*b* to which the resultant force P3 is directed. The support portions 59*d* and 60*c* function to restrict the movement of the position Q at which the axle 14*c* of the intermediate gear 14 contacts the intermediate gear bearings 59*b* and 60*c*, even when the resultant force P3 varies. In this embodiment, the contact positions Q are the inner surfaces of the support portions 59*d* and 60*c*, as seen in FIGS. 10 and 11.

Also, the support portion 59*d* is formed of a support surface 59*e*, as shown in FIG. 11. This support surface 59*e* is formed in an arcuate shape that extends within an angular range of less than 180 degrees ($2\times\theta 2<180°$). The inside diameter of the curvature of the support surface 59*e* is substantially the same as the outside diameter of the axle 14*c* of the intermediate gear 14. Two end parts 59*f* are disposed on both sides of the support surface 59*e* at two positions inclined to the left and right relative to the direction of the resultant force P3 by a specific angle θ2, so as to support the axle 14*c* of the intermediate gear 14 in a balanced manner.

Similarly, the support portion 60*c* is formed of a support surface 60*d*, as shown in FIG. 10. This support surface 60*d* is formed into an arcuate shape that extends within an angular range of less than 180 degrees ($2\times\theta 2<180°$). The inside diameter of the curvature of the support surface 60*d* is substantially the same as the outside diameter of the axle 14*c* of the intermediate gear 14. Two end parts 60*e* are disposed on both sides of the support surface 60*d* at two positions inclined to the left and right relative to the direction of the resultant force P3 by a specific angle θ2, so as to support the axle 14*c* of the intermediate gear 14 in a balanced manner.

In the second embodiment, during the printing operation of the heat transfer printer, the intermediate gear 14 receives the force P3 as a resultant force of the force P1 received from the drive gear 13 and the force P2 received as a reaction when the feed roller gear 15 is rotated, as in the first embodiment shown in FIG. 5. The support surface 60*d* of the support portion 60*c* shown in FIG. 10 and the support surface 59*e* of the support portion 59*d* shown in FIG. 11 are thereby pressed by the axle 14*c* of the intermediate gear 14. At this time, a frictional force resulting from the resultant force P3 acts, as in the case of the first embodiment, on the axle 14*c* of the intermediate gear 14 that rotates in the direction of arrow F1. As a result of the change in the frictional force, a force results that pushes the axle 14*c* of the intermediate gear 14 to the left and right along the support surface 60*d* of the support portion 60*c* and the support surface 59*e* of the support portion 59*d*.

In the second embodiment, as described above, the support portion 59*d* and 60*c* of the intermediate gear bearings 59*b* and 60*b* are provided with the support surfaces 59*e* and 60*d* that are formed into arcuate shapes having an inside diameter of the curvature that is substantially the same as the outside diameter of the axle 14*c* of the intermediate gear 14. Therefore, the axle 14*c* of the intermediate gear 14 can be supported with the arcuate surface. Accordingly, the movement of the intermediate gear 14 along the inner surfaces of the intermediate gear bearings 59*b* and 60*b* becomes limited, and the position Q at which the axle 14*c* of the intermediate gear 14 contacts the intermediate gear bearings 59*b* and 60*b* is less likely to move even when the resultant force P3 changes. As a result, the fluctuation in the rotation of the intermediate gear 14 can be restricted. Consequently, the fluctuation in the rotation of the feed roller 2 driven by the intermediate gear 14 can be restricted, and paper feeding non-uniformities induced by the fluctuation in the rotation of the feed roller 2 can therefore be suppressed. As a result, it is possible to control the conveyance of paper with higher precision.

Furthermore, by forming the supporting surfaces 59*e* and 60*d* of the support portion 59*d* and 60*c* so as to extend within an angular range of less than 180 degrees, the axle 14*c* of the intermediate gear 14 can be supported within by the supporting surfaces 59*e* and 60*d* within the angular range. Therefore, failure of the axle 14*c* of the intermediate gear 14 to engage with the supporting surfaces 59*e* and 60*d* is less likely to occur, even though the supporting surfaces 59*e* and 60*d* are formed into arcuate shapes with their inside diameters of the curvature that are substantially the same as the outside diameter of the axle 14*c* of the intermediate gear 14. As a result, the axle 14*c* of the intermediate gear 14 can engage the support portion 59*d* and 60*c* of the intermediate gear bearings 59*b* and 60*b* in a secure manner, and the axle 14*c* of the intermediate gear 14 can therefore be mounted on the intermediate gear bearings 59*b* and 60*b* in a secure manner.

The embodiments disclosed above should only be considered as examples in all respects and not as being restrictive. The scope of the present invention is expressed by the appended patent claims and not by the above descriptions of the embodiments, and further includes meanings equivalent to the range of the patent claims and all variations within this range.

For example, in the above embodiments, a heat transfer printer is given as an example of an image forming apparatus, but the present invention is not limited thereto. The present invention can be applied to image forming apparatuses other than heat transfer printers, such as inkjet printers or laser printers, as long as such image forming apparatuses include a structure having an intermediate gear that transmits drive force to the feed roller gear of a feed roller that conveys paper.

Figure 12:
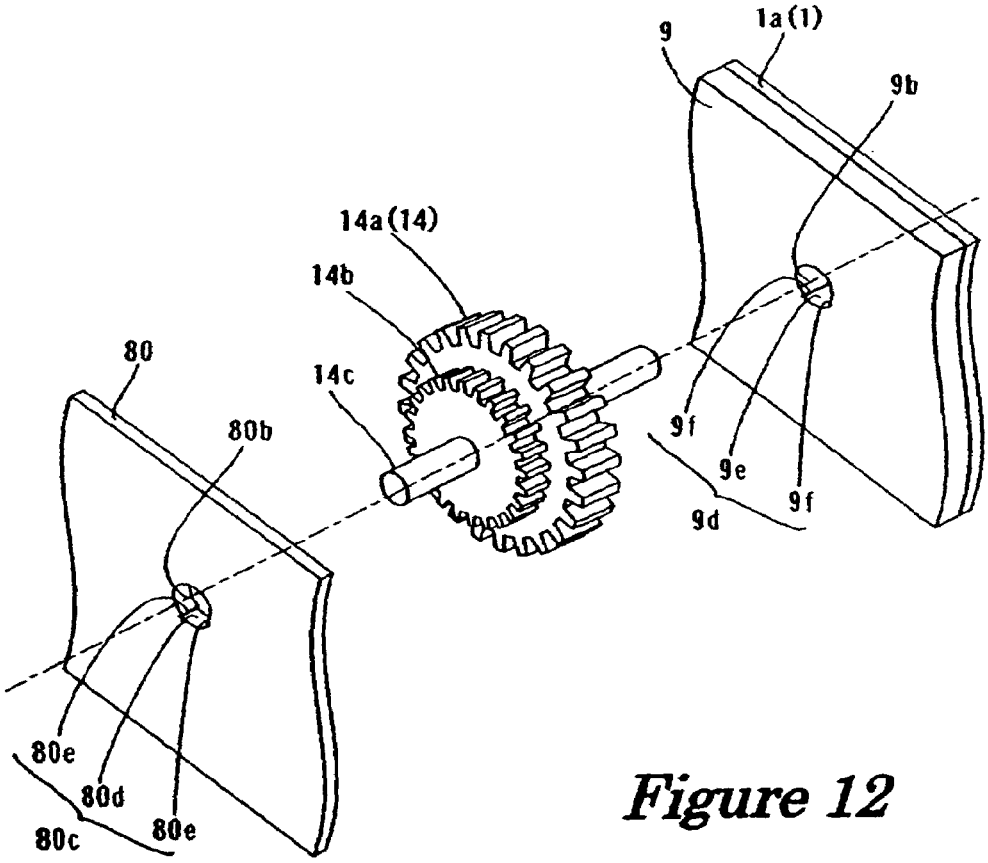
FIG. 12 is a partial exploded perspective view showing the structure for mounting the intermediate gear according to still another embodiment.
Figure 13:
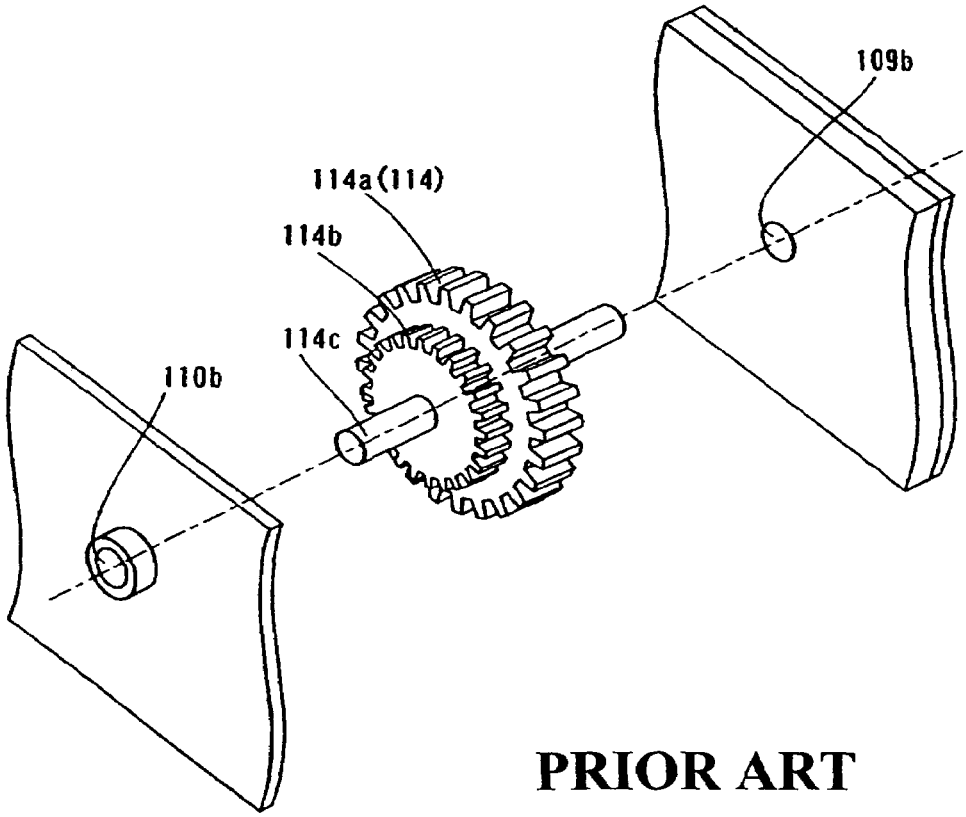
FIG. 13 is an exploded perspective view showing the conventional structure for mounting the intermediate gear in the heat transfer printer.
Figure 14:
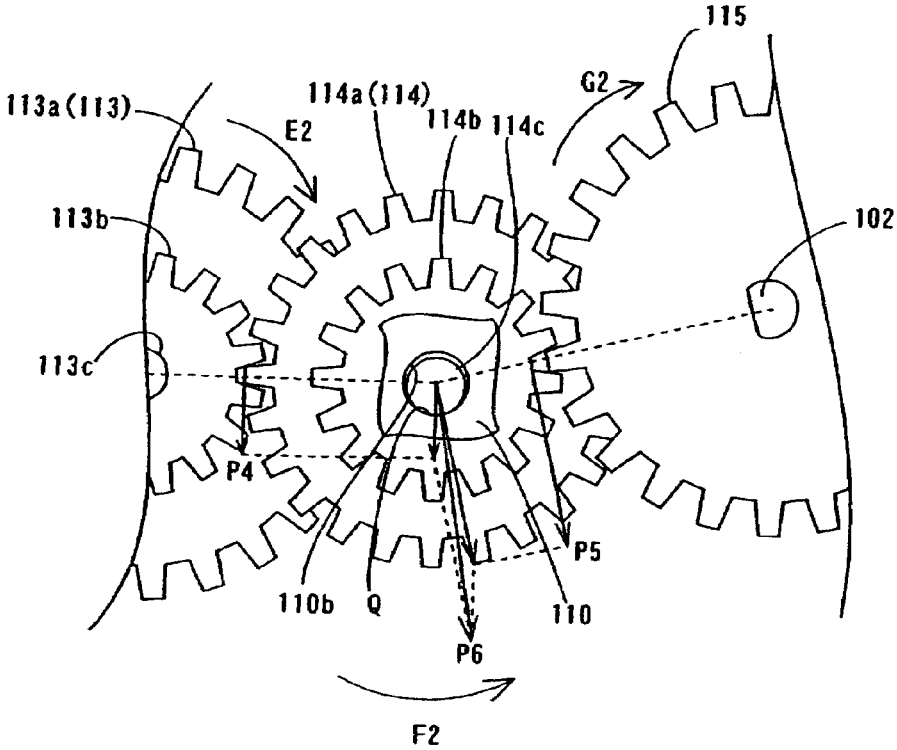
Figure 14 PRIOR ART
FIG. 14 is a partial schematic view showing the intermediate gear, the drive gear, and the feed roller gear in the heat transfer printer according to the conventional example shown in FIG. 13.
Figure 15:
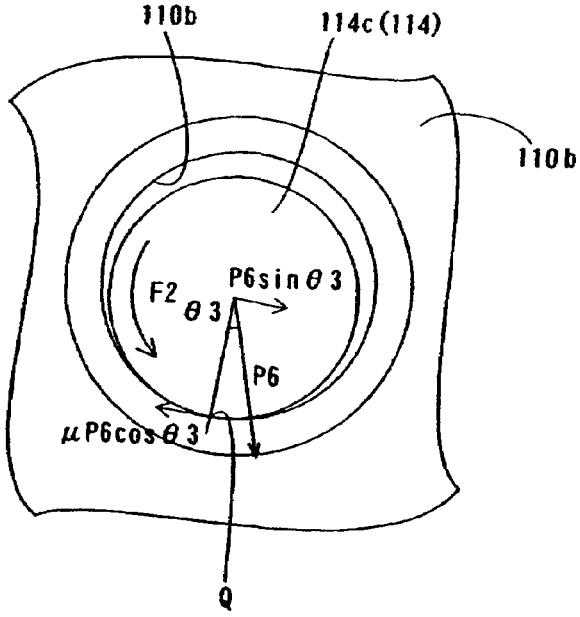
FIG. 15 is a partial schematic view showing the intermediate gear bearing formed in the motor bracket in the heat transfer printer according to the conventional example shown in FIG. 13.
Figure 16:
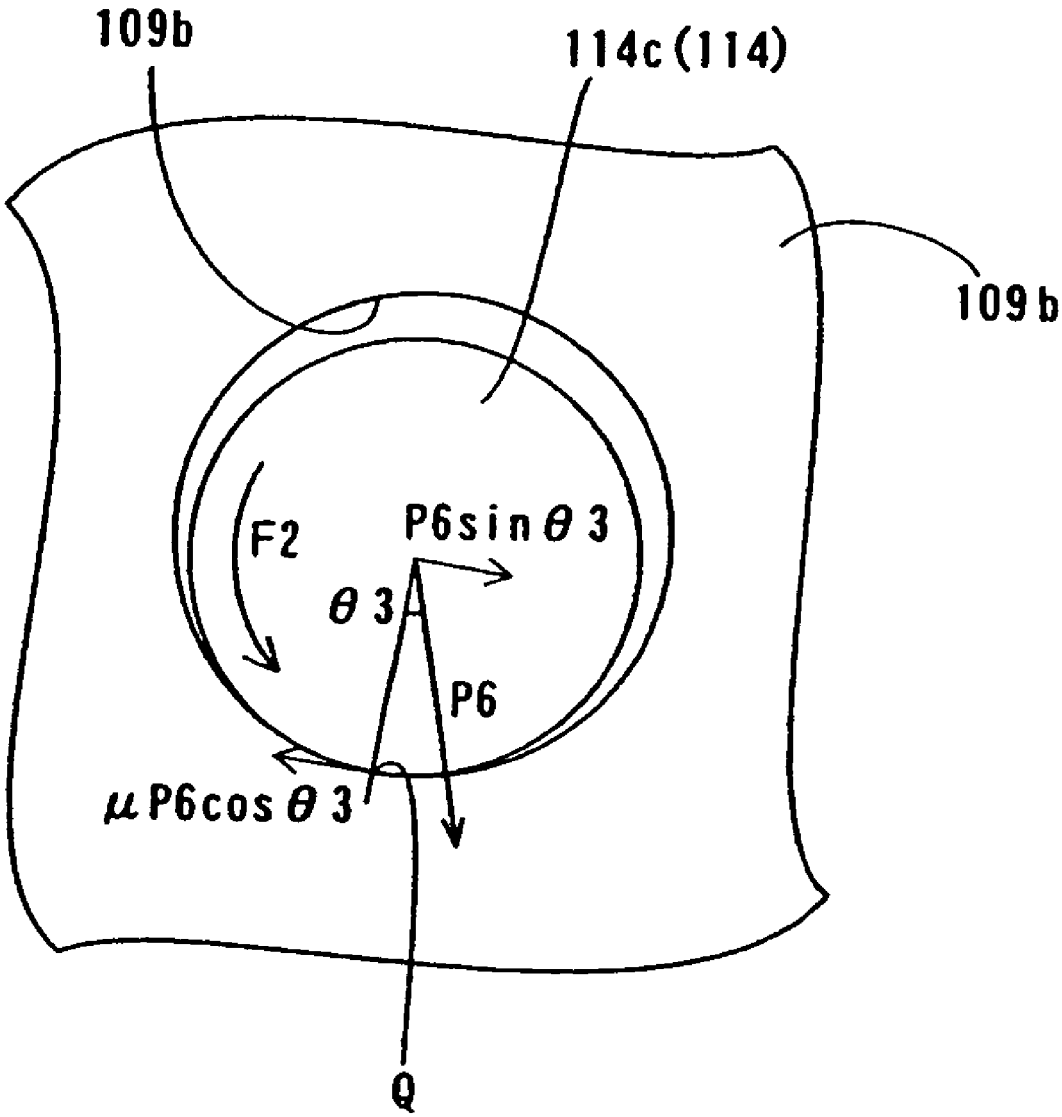
Figure 16 PRIOR ART
FIG. 16 is a partial schematic view showing the intermediate gear bearing formed in the side plate of the heat transfer printer according to the conventional example shown in FIG. 13.

Also, in the first and second embodiments described above, the intermediate gear bearings provided to the metallic motor bracket are formed by burring so as to protrude from the rest of the motor bracket. However, the present invention is not limited to such construction. Specifically, as shown in the modification of FIG. 12, an intermediate gear bearing 80*b* provided to a metallic motor bracket 80 does not need to be formed by burring. Instead, as in shown in FIG. 12, the intermediate gear bearing 80*b* can be formed without protruding from the rest of the motor bracket 80. In this manner, the intermediate gear bearing 80*b* can be formed more easily than in the case of the first and second embodiments described above. In the modification shown in FIG. 12, a support unit 80*c* is provided with a depressed portion 80*d* and two projections 80*e*, similar to the first embodiment.

Also, in the first and second embodiments, the two intermediate gear bearings, namely, the intermediate gear bearing provided to the side plate and the intermediate gear bearing provided to the motor bracket, are provided with support units, which restrict the movement of the contact positions between the axle of the intermediate gear and the intermediate gear bearings when the resultant force varies, to the side of the intermediate gear bearings toward the direction of the resultant force received by the axle of the intermediate gear. However, the present invention is not limited to such construction. A support unit for restricting the movement of the contact positions between the axle of the intermediate gear and the intermediate gear bearings may be provided to only one of the two intermediate gear bearings. With this configuration, the movement of the contact position between the axle of the intermediate gear and the intermediate gear bearings can be restricted even when the resultant force varies, similar to the embodiments described above.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus comprising:

a chassis having first and second side plates;

a feed roller rotatably supported between the first and second side plates for conveying the paper;

a feed roller gear relatively unrotatably coupled to the feed roller;

a motor configured to drive the feed roller;

a drive gear arranged to receive driving force from the motor; and an intermediate gear having a gear portion that engages the drive gear and the feed roller gear and an axle portion that is rotatably supported to the chassis via intermediate gear bearings, at least one of the intermediate gear bearings including a substantially circular inner surface and an elevated stepped portion that is elevated from the circular inner surface, the axle portion of the intermediate gear being arranged to be supported by the elevated stepped portion while the intermediate gear transmits driving force in one direction of the motor from the drive gear to the feed roller gear, the elevated stepped portion including first and second direction ends and a single inner surface that continuously extending between the first and second direction ends and is formed into a substantially arcuate shape concentric to an outer peripheral surface of the axle portion of the intermediate gear with the outer peripheral surface of the axle portion of the intermediate gear being supported only by the inner surface of the elevated stepped portion, with an inside diameter of the inner surface of the elevated stepped portion being substantially the same as an outside diameter of the axle portion of the intermediate gear, the elevated stepped portion being located in a direction of a resultant force with respect to the axle portion, the resultant force being a resultant force of forces received from the drive gear and the feed roller gear when the intermediate gear transmits the driving force in the one direction of the motor from the drive gear to the feed roller gear, the first and second direction ends of the elevated stepped portion being disposed at two locations spaced from the direction of the resultant force by a specific angle in both circumferential directions of the axle portion of the intermediate gear and are located at different heights from each other that are lower than a rotational center of the axle portion.

2. The image forming apparatus according to claim 1, wherein each of the intermediate gear bearings includes the substantially circular inner surface and the elevated stepped portion that is elevated from the respective circular inner surface, the axle portion of the intermediate gear being arranged to be supported by the elevated stepped portions while the intermediate gear transmits driving force of the motor from the drive gear to the feed roller gear.

3. The image forming apparatus according to claim 1, wherein the axle portion and the gear portion of the intermediate gear are formed unitarily as a one-piece member.

4. The image forming apparatus according to claim 1, further comprising:

a resinous side plate member mounted on the first side plate of the chassis and unitarily provided with a feed roller bearing that rotatably supports the feed roller, one of the intermediate gear bearings being formed unitarily with the side plate member.

5. The image forming apparatus according to claim 4, further comprising a motor bracket mounted on the first side plate of the chassis, the motor being mounted to the motor bracket, the other of the intermediate gear bearings being formed unitarily with the motor bracket.

6. The image forming apparatus according to claim 5, wherein the other of the intermediate gear bearings formed on the motor bracket is formed so as to project from the motor bracket.

7. The image forming apparatus according to claim 1, wherein an angular range within which the elevated stepped portion extends relative to the circular inner surface is less than 180°.

* * * * *